US008554104B2

(12) United States Patent
Shimoyama et al.

(10) Patent No.: US 8,554,104 B2
(45) Date of Patent: Oct. 8, 2013

(54) IMAGE FORMING APPARATUS HAVING A FIXING DEVICE INCLUDING AN EXHAUST FAN

(75) Inventors: Atsuhiko Shimoyama, Tahara (JP); Shoichi Yoshikawa, Okazaki (JP); Shigeru Tashiro, Toyokawa (JP); Noboru Oomoto, Toyokawa (JP); Yoshiyuki Toso, Toyokawa (JP); Tou Matsunaga, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 237 days.

(21) Appl. No.: 13/034,944

(22) Filed: Feb. 25, 2011

(65) Prior Publication Data

US 2011/0211860 A1 Sep. 1, 2011

(30) Foreign Application Priority Data

Feb. 26, 2010 (JP) ..... 2010-042150

(51) Int. Cl.
*G03G 21/20* (2006.01)
*G03G 21/00* (2006.01)
*G03G 15/20* (2006.01)

(52) U.S. Cl.
USPC ..... 399/93; 399/92; 399/98; 399/327

(58) Field of Classification Search
USPC ..... 399/92, 93, 98, 327
See application file for complete search history.

(56) References Cited

U.S. PATENT DOCUMENTS 3,914,046 A * 10/1975 Tanaka et al. ..... 399/93
4,693,588 A * 9/1987 Yarbrough et al. ..... 399/93
4,695,151 A * 9/1987 Watanabe ..... 399/92
4,938,786 A * 7/1990 Tonomoto ..... 96/17
5,023,654 A * 6/1991 Matsumoto et al. ..... 355/405

(Continued)

FOREIGN PATENT DOCUMENTS

JP 61204652 A * 9/1986
JP 03116162 A * 5/1991

(Continued)

OTHER PUBLICATIONS

Machine translation of JP 08101626.*

(Continued)

*Primary Examiner* — Walter L Lindsay, Jr.
*Assistant Examiner* — David Bolduc
(74) *Attorney, Agent, or Firm* — Buchanan Ingersoll & Rooney PC

(57) ABSTRACT

An image forming apparatus includes a fixing member for fixing an image onto a sheet in pressure contact with an outer surface thereof; and a heating source for heating the fixing member. A duct is provided in a position facing the fixing member with respect to a width direction perpendicular to a circumferential direction of the fixing member and which has an inlet for taking in fine particles generated from the fixing member. A filter member is provided inside the duct and which can trap the fine particles which flow through the duct. An exhaust fan is provided in the duct upstream or downstream from the filter member for generating an air flow going from the inlet to an outlet of the duct. A control section controls the operation of the exhaust fan according to initial burst conditions under which the fine particles are emitted from the fixing member.

17 Claims, 8 Drawing Sheets

(56) References Cited

U.S. PATENT DOCUMENTS

| | | | | | |
|---|---|---|---|---|---|
| 5,155,531 | A | * | 10/1992 | Kurotori et al. | 399/93 |
| 5,307,132 | A | * | 4/1994 | Tsuchiya | 399/70 |
| 5,390,006 | A | * | 2/1995 | Wakabayashi et al. | 399/92 |
| 5,666,187 | A | * | 9/1997 | Kim | 355/30 |
| 6,141,512 | A | * | 10/2000 | Nagano et al. | 399/92 |
| 6,173,132 | B1 | * | 1/2001 | Kida et al. | 399/44 |
| 7,313,342 | B2 | * | 12/2007 | Katayama et al. | 399/93 |
| 7,343,116 | B2 | * | 3/2008 | Seorl et al. | 399/93 |
| 7,421,237 | B2 | * | 9/2008 | Funato et al. | 399/341 |
| 7,446,787 | B2 | * | 11/2008 | Kishi | 347/156 |
| 7,973,291 | B2 | | 7/2011 | Kagawa et al. | |
| 8,139,974 | B2 | * | 3/2012 | Sakuwa | 399/92 |
| 2008/0145092 | A1 | * | 6/2008 | Tomatsu et al. | 399/93 |
| 2008/0217556 | A1 | * | 9/2008 | Kagawa et al. | 250/423 R |
| 2008/0219695 | A1 | * | 9/2008 | Doshohda et al. | 399/93 |
| 2011/0142483 | A1 | * | 6/2011 | Oomoto et al. | 399/93 |
| 2011/0200371 | A1 | * | 8/2011 | Oomoto et al. | 399/333 |
| 2011/0211859 | A1 | * | 9/2011 | Shimoyama et al. | 399/93 |

FOREIGN PATENT DOCUMENTS

| | | | | |
|---|---|---|---|---|
| JP | 03-220555 | A | | 9/1991 |
| JP | 5-019582 | A | | 1/1993 |
| JP | 06-059550 | A | | 3/1994 |
| JP | 08101626 | A | * | 4/1996 |
| JP | 2000250368 | A | * | 9/2000 |
| JP | 2003-140514 | A | | 5/2003 |
| JP | 2008-251514 | A | | 10/2008 |
| JP | 2009-031577 | A | | 2/2009 |
| JP | 2010117421 | A | * | 5/2010 |

OTHER PUBLICATIONS

Office Action (Preliminary Notice of Rejection) dated Jan. 17, 2012, issued in the corresponding Japanese Patent Application No. 2010-042150, and an English Translation thereof. (8 pages).

* cited by examiner

IMAGE FORMING APPARATUS HAVING A FIXING DEVICE INCLUDING AN EXHAUST FAN

This application is based on an application No. 2010-42150 filed in Japan on Feb. 26, 2010, the entire content of which is hereby incorporated by reference.

BACKGROUND ART

The present invention relates to an image forming apparatus, more particularly to an electrophotographic image forming apparatus such as printers, copying machines and facsimile machines.

It is known for this kind of an electrophotographic image forming apparatus that several kinds of chemical substances are emitted during imaging operation. Typical chemical substances to be emitted (chemical emission) include ozone generated during charging of a photoconductor and toner powder dust generated during developing or fixing operation. Conventional solutions to the chemical emission include taking measures against the emission source of such chemicals emission so as to decline the emission amount itself, and providing a filter to prevent emitted substances from being discharged to the outside of the apparatus. For example in JP H5-19582 A, when ozone is sucked, a duct through which the ozone passes is structured to have a smaller opening area, so that the ozone takes longer time to pass through the filter.

However, with a recent increase in awareness of global environmental conservation, fine particles which are substances different from ozone or toner powder dust, particularly ultra fine particles (with a particle size of 100 nm or less) generated from electrophotographic image forming apparatuses have come to be seen as a problem. Up to now, it has been unknown where in the inside of an image forming apparatus the ultra fine particles are generated, and therefore it has been impossible to take effective measures for the problem.

As a result of the investigation conducted by the inventor of the present invention, it was found out that in an electrophotographic image forming apparatus, the ultra fine particles are mainly generated in a fixing device. Further, if an exhaust fan, which is for sucking air of the fixing device containing the ultra fine particles, is constantly used at a maximum rotation frequency, the fixing device is cooled, which results in deteriorated fixability and increased energy consumption.

As shown in FIG. 10A, a general fixing member 300 is composed of layers including a base material 301 made of a cylindrical core metal or an annular endless belt, a rubber layer 302 provided so as to cover the outer surface of the base material 301, and an outer layer 303 provided so as to cover the outer surface of the rubber layer 302. In this example, a heater 305 (equivalent to a heater 133 in FIG. 1) is provided in an internal space of the base material 301 for heating the fixing member 300 to a specified target temperature (a fixing temperature in the range of 180° C. to 200° C.). The rubber layer 302, which is made of a silicone rubber material, has heat tolerance to the fixing temperature and elasticity for allowing for the width of a nip section. The outer layer 303 is made of, for example, PFAs (tetra fluoro ethylene-PerFluoro Alkylvinyl ether copolymers) for aiding release of a sheet (recording material such as paper sheets) which passed through the nip section. An end portion 302*e* of the rubber layer 302 and an end portion 303*e* of the outer layer 303 are positioned on the inside of an end portion 301*e* of the base material 301 respectively with respect to a direction along a central shaft C of the base material 301.

According to the investigation conducted by the inventor of the present invention, siloxane (designated by reference sign G) is generated in the form of ultra fine particles from the silicone rubber material which constitutes the rubber layer 302 when the base material 301, the rubber layer 302 and the like are heated with the heater 305 (reference sign H shows heat rays) as shown in FIG. 10B. Since the outer layer 303 made of PFAs and the like typically has a nature hard to transmit the ultra fine particles (gas barrier property), siloxane G is emitted from the end portion 302*e* of the rubber layer 302.

Examples of siloxanes include hexamethyldisiloxane (abbreviation: L2, molecular formula: $C_6H_{18}O_1Si_2$), hexamethylcyclotrisiloxane (abbreviation: D3, molecular formula: $C_6H_{18}O_3Si_3$) octamethyltrisiloxane (abbreviation: L3, molecular formula: $C_8H_{24}O_2Si_3$) octamethylcyclotetrasiloxane (abbreviation: D4, molecular formula: $C_8H_{24}O_4Si_4$), decamethyltetrasiloxane (abbreviation: L4, molecular formula: $C_{10}H_{30}O_3Si_4$) decamethylcyclopentasiloxane (abbreviation: D5, molecular formula: $C_{10}H_{30}O_5Si_5$) dodecamethylpentasiloxane (abbreviation: L5, molecular formula: $C_{12}H_{36}O_4Si_5$), and dodecamethylcyclohexasiloxane (abbreviation: D6, molecular formula: $C_{12}H_{36}O_6Si_6$).

An experiment conducted by the inventor of the present invention indicates that emission of siloxane G rapidly increases at the moment when the temperature of the fixing member 300 approximates 180° C. and the emission stops after the elapse of about 2 minutes. Such conditions for discharge of fine particles from the fixing member 300 (rubber layer 302 in particular) are called "initial burst conditions".

SUMMARY OF INVENTION

An image forming apparatus in one aspect of the invention comprises:

a fixing member having a cylindrical or annular shape for fixing an image onto a sheet which is in pressure contact with an outer surface thereof;

a heating source for heating the fixing member to a fixing temperature;

a duct which is provided in a position facing the fixing member with respect to a width direction perpendicular to a circumferential direction of the fixing member and which has an inlet for taking in fine particles generated from the fixing member;

a filter member which is provided inside the duct and which can trap the fine particles which flow through the duct;

an exhaust fan provided in the duct upstream or downstream from the filter member for generating an air flow going from the inlet to an outlet of the duct; and a control section for controlling the operation of the exhaust fan according to initial burst conditions under which the fine particles are emitted from the fixing member.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Figure 1:
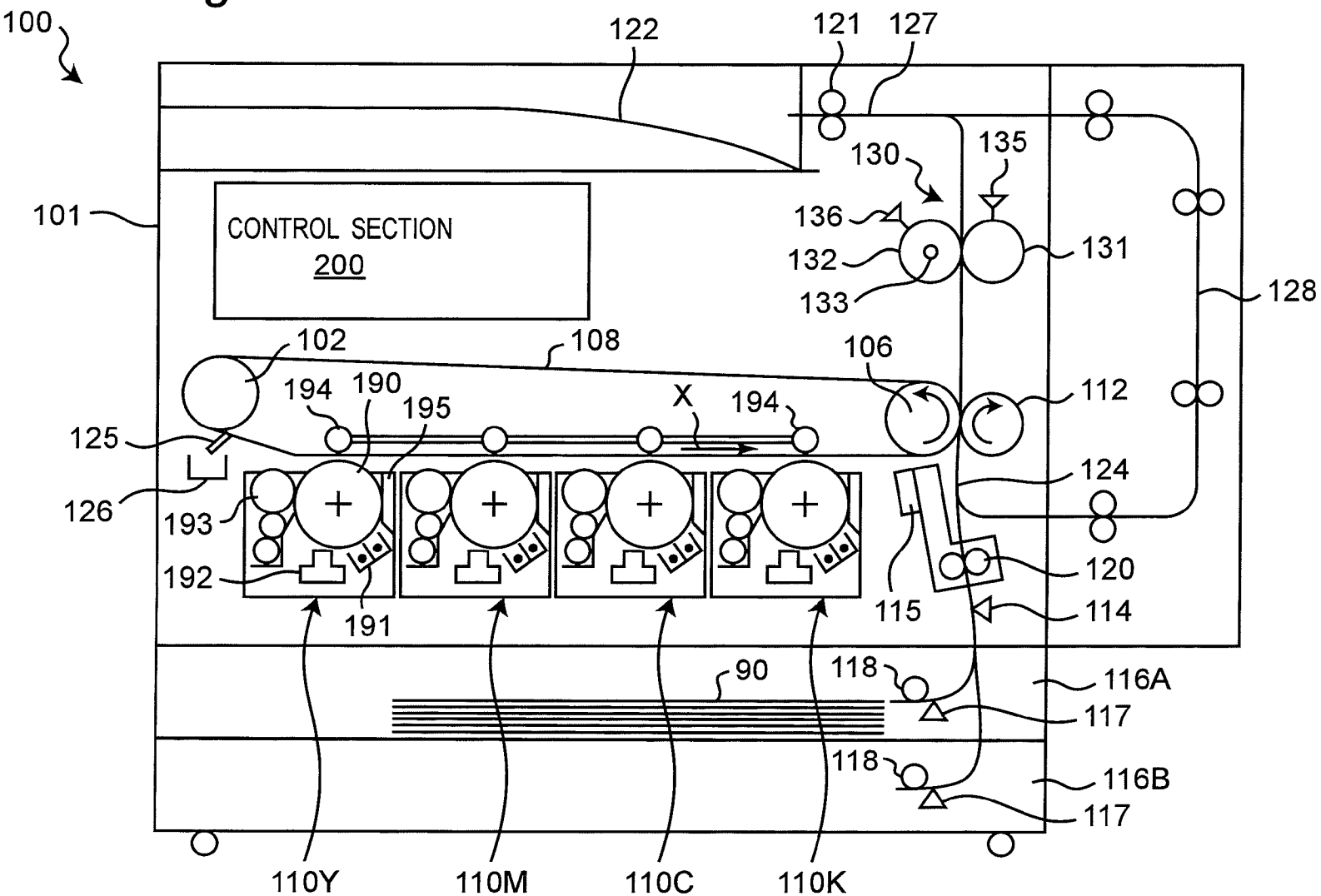
FIG. 1 is a view showing a cross sectional configuration of an image forming apparatus in one embodiment of the invention.

FIG. 1 shows a schematic configuration of a color tandem-type image forming apparatus 100 in one embodiment of the invention. The image forming apparatus 100, which is a multi-functional machine having functions of a scanner, a copier, a printer and other apparatuses, is called MFT (Multi Function Peripheral).

The image forming apparatus 100 includes an intermediate transfer belt 108 as an annular intermediate transfer body provided generally in the center inside a main body casing 101, the intermediate transfer belt 108 being wound around two rollers 102, 106 and moving in a circumferential direction. One roller 102 out of two rollers 102 and 106 is placed on the left-hand side in the drawing, while the other roller 106 is placed on the right-hand side in the drawing. The intermediate transfer belt 108 is supported on these rollers 102, 106 and is rotated in an arrow X direction.

Imaging units 110Y, 110M, 110C and 110K as printing sections corresponding to respective color toners of yellow (Y), magenta (M), cyan (C) and black (K) are placed below the intermediate transfer belt 108 side by side in order from the left-hand side in the drawing.

The respective imaging units 110Y, 110M, 110C and 110K have completely similar configuration except for a difference in toner color that the respective units handle. More specifically, the yellow imaging unit 110Y for example is integrally composed of a photoconductor drum 190, a charging device 191, an exposure device 192, a developing device 193 for performing development with use of toner, and a cleaner device 195. A primary transfer roller 194 is provided in a position facing the photoconductor drum 190 across the intermediate transfer belt 108.

At the time of image formation, the surface of the photoconductor drum 190 is first uniformly charged with the charging device 191, and then the surface of the photoconductor drum 190 is exposed with the exposure device 192 in response to an image signal inputted from an unshown external unit to form a latent image thereon. Next, the latent image on the surface of the photoconductor drum 190 is developed into a toner image with the developing device 193. This toner image is transferred onto the intermediate transfer belt 108 upon voltage application to between the photoconductor drum 190 and the primary transfer roller 194. The transfer residual toner on the surface of the photoconductor drum 190 is cleaned with the cleaner device 195.

As the intermediate transfer belt 108 moves in the arrow X direction, overlapped toner images of four colors are formed as inputted images on the intermediate transfer belt 108 with each of the imaging units 110Y, 110M, 110C and 110K.

Provided on the left-hand side of the intermediate transfer belt 108 are a cleaning device 125 for removing residual toner from the surface of the intermediate transfer belt 108 and a toner collecting box 126 for collecting the toner removed with the cleaning device 125. A secondary transfer roller 112 as a secondary transfer member is provided on the right-hand side of the intermediate transfer belt 108 across a conveying path 124 for paper sheets. A conveying roller 120 is provided at a position corresponding to the upstream of the secondary transfer roller 112 on the conveying path 124. An optical concentration sensor 115 is provided as a toner concentration sensor for detecting toner patterns on the intermediate transfer belt 108.

A fixing device 130 is provided on the upper right part inside the main body casing 101 as a fixing section for fixing toner onto paper sheets. The fixing device 130 includes a heating roller 132 as a fixing member extending perpendicularly to the page of FIG. 1 and a pressure roller 131 as a pressure member. The heating roller 132 is heated to a specified target temperature (a fixing temperature in the range of 180° C. to 200° C. in this example) with a heater 133 as a heating source. The pressure roller 131 is biased toward the heating roller 132 with an unshown spring. Accordingly, the pressure roller 131 and the heating roller 132 form a nip section for fixation. As a paper sheet 90 carrying a toner image transferred thereon passes through the nip section, the toner image is fixed onto the paper sheet 90.

Paper cassettes 116A, 116B as paper feed ports for storing paper sheets 90 as printing media, on which output images should be formed, are provided in two levels in the lower part of the main body casing 101. The paper cassettes 116A, 116B are respectively equipped with a feed roller 118 for sending out paper sheets and a feeding sensor 117 for sensing the sent-out paper sheets. For the sake of simplicity, the drawing shows the state in which the paper sheets 90 are stored only in the paper cassette 116A.

A control section 200 for controlling the operation of the entire image forming apparatus is provided in the main body casing 101.

Figure 3:
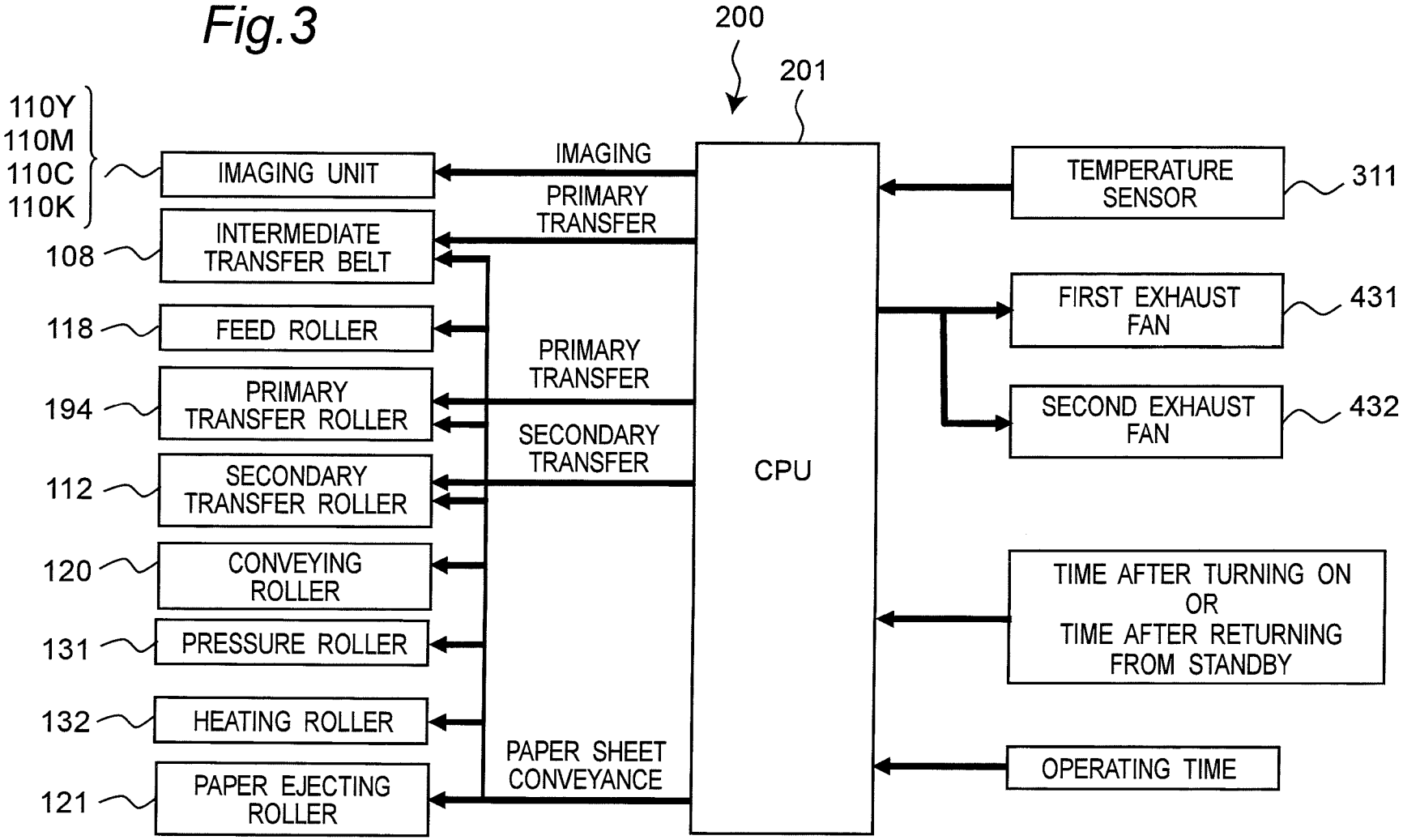
FIG. 3 is a control block diagram of a principal part of the image forming apparatus.

As shown in FIG. 3, the control section 200 is constituted of a CPU (Central Processing Unit) 201 to control, in this example, the respective imaging units 110Y, 110M, 110C and 110K, the intermediate transfer belt 108, the feed roller 118, the primary transfer roller 194, the secondary transfer roller 112, the conveying roller 120, the pressure roller 131, the heating roller 132, and a paper ejecting roller 121. The control section 200 also controls a later-described temperature sensor 311, shutters 404, 404', a passage switching valve 405, an air introduction valve 407, first filter members 422, 423, an exhaust fan 430 and an air introduction fan 431.

At the time of image formation, paper sheets 90 shown in FIG. 1 are sent out one by one with the feed roller 118 from, for example, the paper cassette 116A to the conveying path 124 under control by the control section 200. The paper sheets 90 sent out to the conveying path 124 are sent into a toner transfer position between the intermediate transfer belt 108 and the secondary transfer roller 112 by the conveying roller 120 with the timing decided by a resist sensor 114. Meanwhile, an overlapped toner image of four colors is formed on the intermediate transfer belt 108 with the respective imaging units 110Y, 110M, 110C and 110K as mentioned before. The toner image of four colors on the intermediate transfer belt 108 is transferred onto a paper sheet 90, which was sent into the toner transfer position, with the secondary transfer roller 112. The paper sheet 90 with the toner image transferred thereon is heated and pressed while passing through the nip section formed between the pressure roller 131 and the heating roller 132 of the fixing device 130. As a result, the toner image is fixed onto the paper sheet 90. The paper sheet 90 with the toner image fixed thereto is then discharged with the paper ejecting roller 121 into a paper ejection tray section 122 provided on the upper surface of the main body casing 101 through a paper ejecting path 127. In this example, a switch-back conveying path 128 is provided for resending paper sheets 90 into the toner transfer position in the case of double-side printing.

Figure 2:
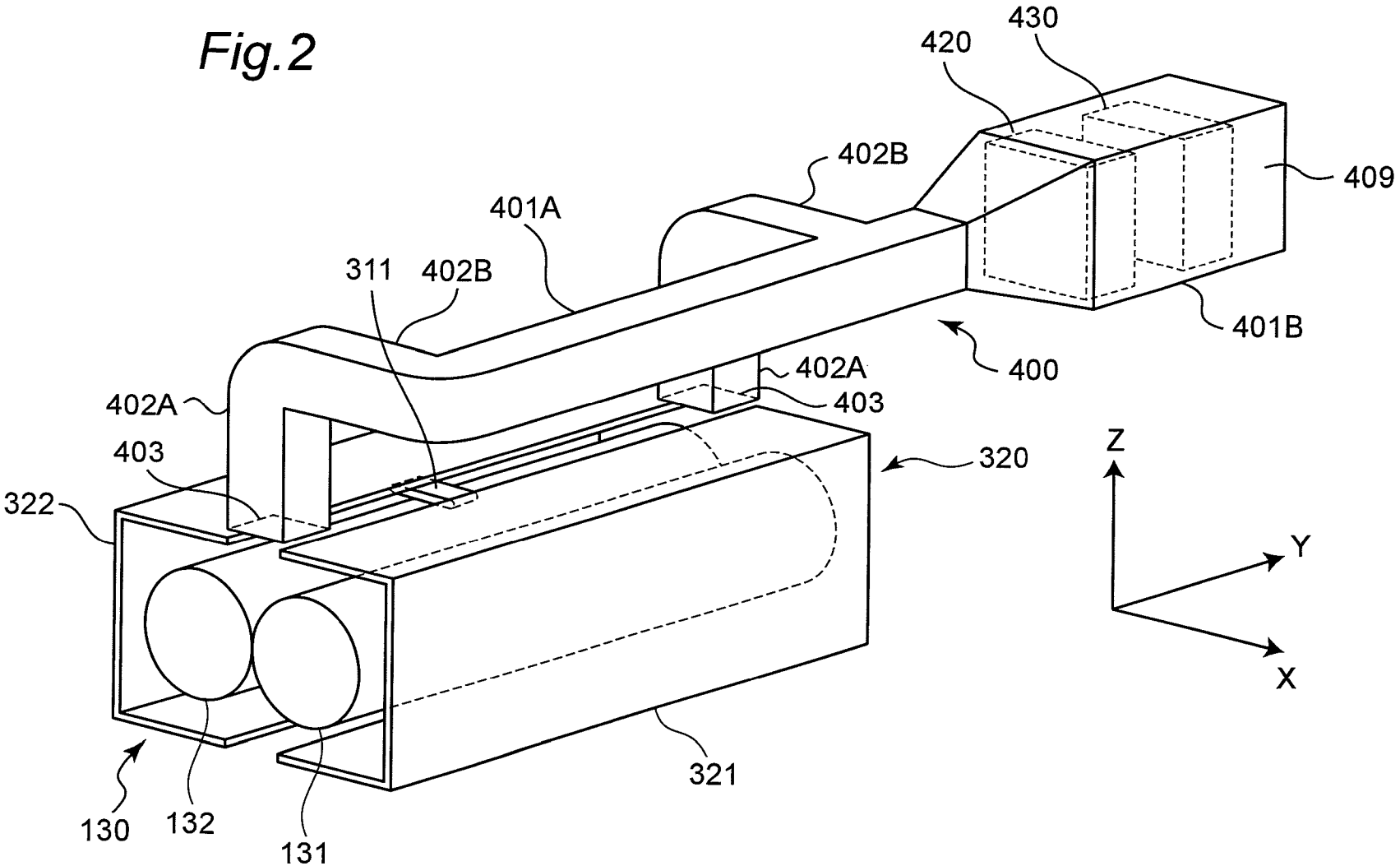
FIG. 2 is a view showing a configuration in the vicinity of a fixing device of the image forming apparatus.

FIG. 2 shows the vicinity of the fixing device 130 included in the image forming apparatus 100 as viewed in an oblique direction.

In a configuration example of the fixing device 130, the heating roller 132 and the pressure roller 131 of the fixing device 130 are composed of layers including a base material (core metal), a rubber layer and an outer layer in completely the same manner as the fixing member 300 shown in FIG. 17A. In FIG. 2, the heating roller 132, which is supported onto the main body casing 101 via an unshown frame, is rotated in a counterclockwise direction around its central axis with an unshown drive motor. The pressure roller 131 rotates in a clockwise direction with the rotation of the heating roller 132. A temperature sensor 311 constituted of a thermistor for measuring the temperature of the heating roller 132 is provided above the heating roller 132 at a central position with respect to an axial direction (direction Y) of the heating roller 132 so as to be in contact with the heating roller 132.

The fixing device 130 has a casing 320 supported and fixed onto the main body casing 101 via an unshown frame. The casing 320 has a first casing 321 for covering the pressure roller 131 and a second casing 322 for covering the heating roller 132. Each of the first casing 321 and the second casing 322 has a squared U-shaped cross section with their openings facing each other across a clearance, through which the paper sheets 90 travel.

In this embodiment, a duct 400 supported and fixed onto the main body casing 101 via an unshown frame is provided in the vicinity of the fixing device 130. The duct 400 may be made of any one of resin materials having heat tolerance to the fixing temperature or metallic materials such as aluminum and iron.

The duct 400 has a pair of inlets 403, 403 provided in a clearance between the first casing 321 and the second casing 322 at positions corresponding to both the ends of the heating roller 132 with respect to the axial direction (direction Y) of the heating roller 132. The duct 400 is further composed of a pair of vertical sections 402A, 402B each extending upward in a vertical direction (direction Z) from the inlets 403, 403, a pair of first horizontal sections 402B, 402B each curved from the upper part of these vertical sections 402A, 402A and extending in a horizontal direction (direction X), a second horizontal section 401A joining with these first horizontal sections 402B, 402B and extending in the direction Y, and an expanded section 401B continuing to the downstream of the second horizontal section 401A and having a cross section larger than the cross section of the second horizontal section 401A. A downstream end section of the expanded section 401B constitutes an outlet 409 of the duct 400. The outlet 409 of the duct 400 is opened toward the outside or the inside of the main body casing 101.

Inside the expanded section 401B, an exhaust fan 430 is provided in the vicinity of the outlet 409. The exhaust fan 430 generates an air flow going from a pair of the inlets 403, 403 to the outlet 409 of the duct 400. Also inside the expanded section 401B, a first filter member 420 is provided upstream from the exhaust fan 430 with respect to the air flow.

As the first filter member 420, commercial items such as Elitolon (registered trademark of Toyobo Co., Ltd.) that is an electrostatic filter made by Toyobo Co., Ltd., and micronAir (registered trademark of Freudenberg & Co.) made by Freudenberg & Co. Kommanditgesellschaft are used so that ultra fine particles, particularly siloxane, generated from the rubber layer can be trapped. Filtering media having carbon or PTFE (polytetrafluoroethylene) as a main component may be used from a viewpoint of securing the heat tolerance of the filter member.

First Embodiment

Figure 4A:
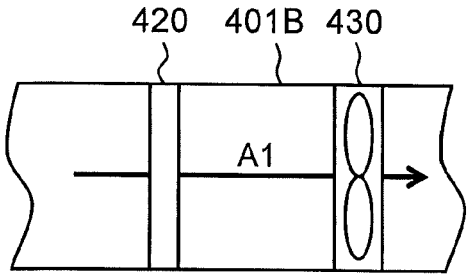
FIG. 4 is a detail view showing configuration and operation inside a duct of the image forming apparatus.

FIG. 4A shows a cross sectional configuration of the internal expanded section 401B and the vicinity thereof in the image forming apparatus 100. The filter member 420 is fixedly provided in the expanded section 401B. The size of the cross section of the first filter member 420 is equal to the size of the cross section of the expanded section 401B at a position where the first filter member 420 is provided. Consequently, in the state shown in FIG. 4A, an air flow A1 generated by the exhaust fan 430 all passes through the filter member 420. On the other hand, in the state shown in FIG. 4B, an air flow A2 generated by the exhaust fan 430 also all passes through the first filter member 420 as in FIG. 4A.

Figure 7A:
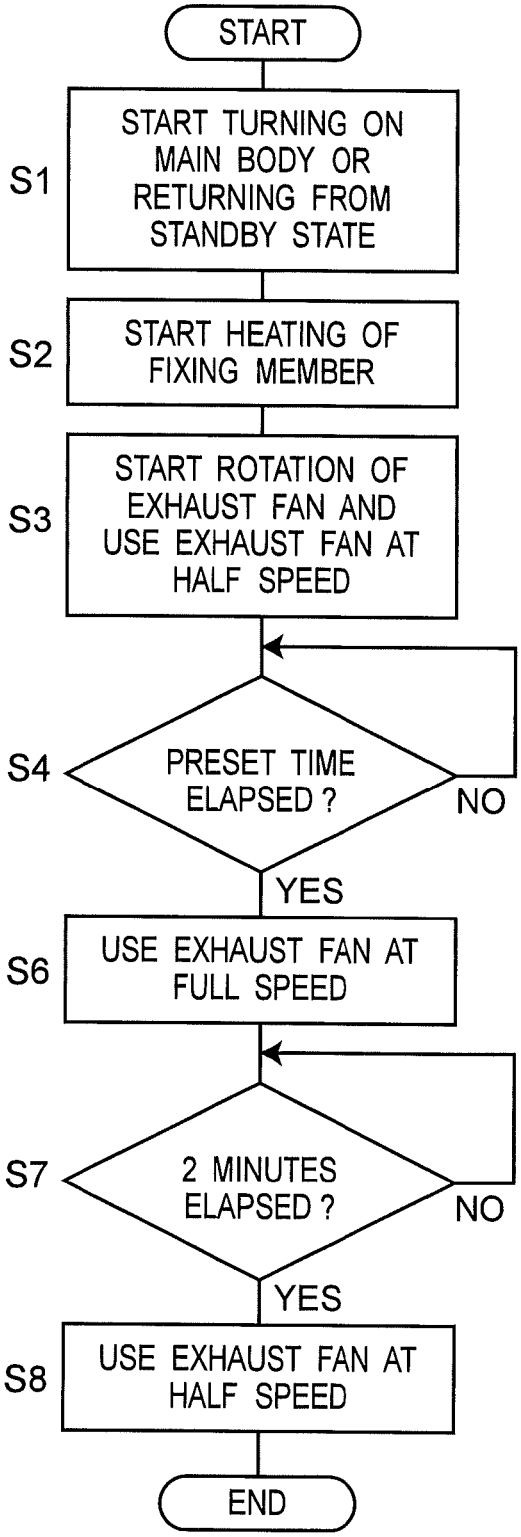
FIGS. 7A and 7B are flow charts for control of a rotation frequency of the exhaust fan by a control section of the image forming apparatus, respectively.

FIG. 7A shows a flow chart for control of the exhaust fan 430 by the control section 200 of the image forming apparatus 100. Table 1 shows control of the exhaust fan 430 by the control section 200 in every generation state of the ultra fine particles.

TABLE 1

| State | (a) | (b) | (c) |
|---|---|---|---|
| Ultra fine particles | Small amount | Large amount | Small amount |
| Time | In 30 sec. after turning on main body or in 20 sec. after start of returning from standby state | After elapse of 30 sec. after turning on main body or after elapse of 20 sec. after start of returning from standby state | After elapse of 2 min. after attaining to state (b) |
| Fixing temp. | Less than 180° C. | 180° C. | 180° C. |
| Exhaust fan | Half speed | Full speed | Half speed |

Figure 4B:
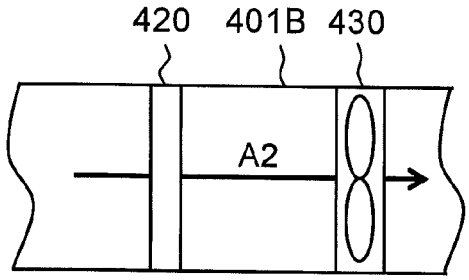

Description is now given of the operation of the exhaust fan 430 with reference to FIG. 4A, FIG. 4B, FIG. 7A and Table 1.

(i) In this example, the image forming apparatus 100 is first turned on or returned from a standby state (Step S1 in FIG. 7A), and then the heating roller 132 is heated with the heater 133 (Step S2 in FIG. 7A). Then as shown in FIG. 4A, the control section 200 controls the operation of the exhaust fan 430 to start rotation and uses the exhaust fan 430 at a rotation frequency that is a half of a maximum rotation frequency (hereinafter referred to as "half speed") of the exhaust fan 430

(Step S3 in FIG. 7A, state (a) in Table 1). Next, the control section 200 determines whether or not a preset time set as a period of time until the start of emission of ultra fine particles has elapsed (Step S4 in FIG. 7A). More specifically, the control section 200 determines whether or not 30 seconds, that is a preset standby time, has elapsed after the start of heating of the heating roller 132 upon turning on the image forming apparatus 100, or determines whether or not 20 seconds, that is a preset standby time, has elapsed after the start of heating of the heating roller 132 upon returning from the standby state of the image forming apparatus 100. If the control section 200 determines that the preset time has not yet elapsed (NO in Step S4 in FIG. 7A), then it determines whether or not the preset time has elapsed again (Step S4 in FIG. 7A). Accordingly, the control section 200 controls the operation of the exhaust fan 430 and uses the exhaust fan 430 at half speed until the preset time has elapsed after the start of heating of the heating roller 132. Since the control section 200 controls the operation of the exhaust fan 430 based on the time, the exhaust fan 430 can be controlled with simple configuration as compared with the case of using sensors and the like. Therefore, it becomes possible to reliably reduce energy consumption and to control the rotation frequency of the exhaust fan 430 with simple configuration.

(ii) On the other hand, if the control section 200 determines that the preset time has elapsed ("YES" in Step S4 in FIG. 7A), it then controls the operation of the exhaust fan 430 as shown in FIG. 4B, and uses the exhaust fan 430 at a rotation frequency increased to the maximum rotation frequency (hereinafter referred to as "full speed") (Step S6 in FIG. 7A, state (b) in Table 1).

(iii) Next, the control section 200 determines whether or not 2 minutes, that is the preset first operating time as a period of time from the time when the emission of ultra fine particles is rapidly increased to the time when the emission is settled down, after the elapse of the standby time, has elapsed (Step S7 in FIG. 7A). If the control section 200 determines that 2 minutes has not yet elapsed ("NO" in Step S7 in FIG. 7A), then it determines whether or not 2 minutes has elapsed again (Step S7 in FIG. 7A). The period of time of "2 minutes" is one of the aforementioned initial burst conditions. If the control section 200 determines that 2 minutes has elapsed ("YES" in Step S7 in FIG. 7A), then it controls the operation of the exhaust fan 430 as shown in FIG. 4A to decrease the rotation frequency, and uses the exhaust fan 430 at half speed (Step S8 in FIG. 7A, state (c) in Table 1). As a consequence, during the time of the 2 minutes that is one of the initial burst conditions, the air flow A2 containing a large number of the ultra fine particles passes through the filter member 420 more than during the time except for the 2 minutes. Therefore, as compared with the case when the exhaust fan 430 is constantly used at full speed, the ultra fine particles can be collected with more efficiency. Further, since the first filter member 420 is an electrostatic filter, the ultra fine particles can more efficiently be trapped due to Coulomb force. On the other hand, during the time other than the 2 minutes, air near the heating roller 132 will not unduly be sucked to the outside of the apparatus by the exhaust fan 430 due to the air flow A2, which prevents the heating roller 132 being cooled and the fixability of the fixing device 130 being deteriorated.

As described in (i) to (iii), the control section 200 determines whether or not the preset time has elapsed, i.e., determines whether or not initial burst conditions are fulfilled. And the control section 200 operates the exhaust fan 430, i.e., the rotation frequency thereof is controlled. Consequently, only when specific temperature or time is satisfied, large part of the air flow A2 containing a large number of the ultra fine particles passes through the filter member 420. Therefore, it becomes possible to efficiently collect the ultra fine particles. Moreover, air near the heating roller 132 will not unduly be sucked to the outside of the apparatus by the exhaust fan 430, which prevents the heating roller 132 being cooled and the fixability of the fixing device 130 being deteriorated. Furthermore, the control section 200 controls the operation of the exhaust fan 430 so that the exhaust fan 430 is not constantly used at full speed. Therefore, according to this image forming apparatus, it becomes possible to prevent diffusion of fine particles to the environment inside and around the apparatus and desirably secure fixability of the fixing device 130, as well as to reduce energy consumption.

Figure 7B:
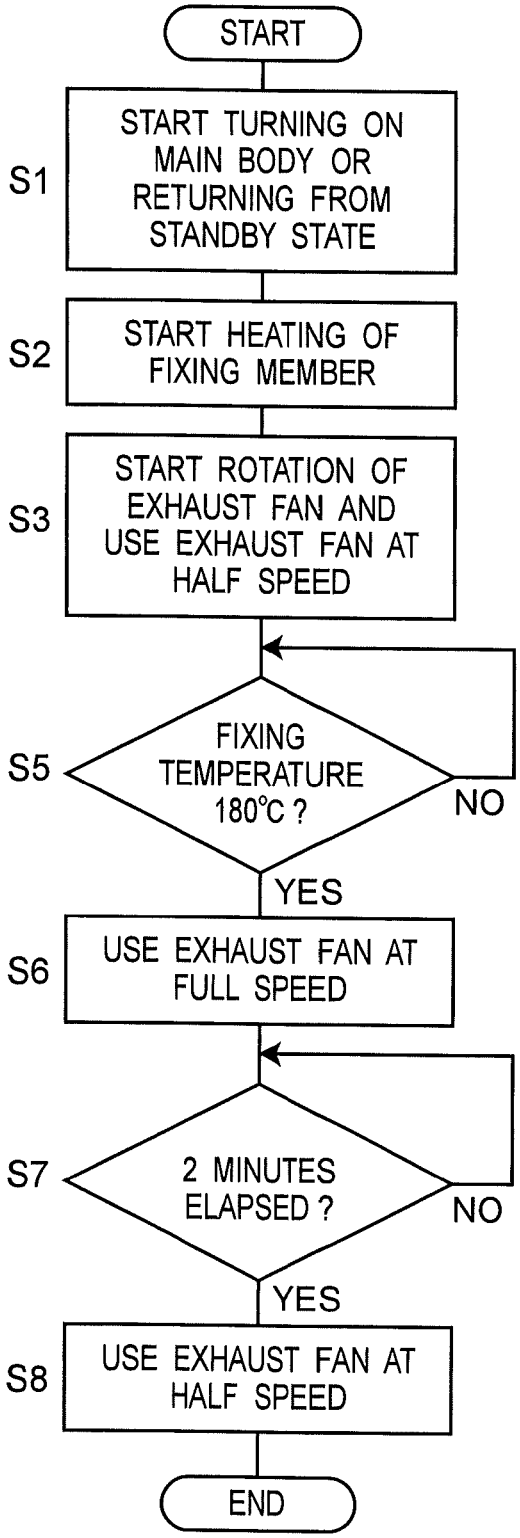

The control section 200 may control the exhaust fan 430 according to the control shown in the flow chart for control in FIG. 7B in place of the flow chart in FIG. 7A. It is to be noted that in the flow chart of FIG. 7B, the steps identical to those in the flow chart of FIG. 7A are designated by identical step number to omit detailed explanation.

(i') As shown in FIG. 7B, in place of Step S4 of FIG. 7A, the initial burst conditions are determined based on the fixing temperature. In this case, the control section 200 determines whether or not the fixing temperature of the heating roller 132 measured with a temperature sensor 311 has reached a threshold temperature of 180° C. (Step S5 in FIG. 7B). The temperature of "180° C.", which is the temperature at which emission of the ultra fine particles can be regarded to increase rapidly, is one of the aforementioned initial burst conditions. If the control section 200 determines that the fixing temperature has not yet reached 180° C. ("NO" in Step S5 in FIG. 7B), it determines whether or not the fixing temperature has reached 180° C. again (Step S5 in FIG. 7B). Consequently, the control section 200 controls the operation of the exhaust fan 430, and uses the exhaust fan 430 at half speed until the temperature of the heating roller 132 measured with the temperature sensor 311 has reached 180° C. that is one of the initial burst conditions. Since the control section 200 controls the operation of the exhaust fan 430 based on the temperature, the exhaust fan 430 can be controlled more precisely on the temperature, that is one of the initial burst conditions, as compared with the case when the control section controls the operation of the exhaust fan 430 based on the time. Therefore, as compared with the case when the exhaust fan 430 is constantly used at full speed, it becomes possible to reliably reduce energy consumption and to collect the ultra fine particles with more efficiency. And, air near the heating roller 132 will not unduly be sucked to the outside of the apparatus by the exhaust fan 430 due to the air flow A2, which prevents the heating roller 132 being cooled and the fixability of the fixing device 130 being deteriorated.

(ii') On the other hand, if the control section 200 determines that the fixing temperature has reached 180° C. ("YES" in Step S5 in FIG. 7B), it then controls the operation of the exhaust fan 430 as shown in FIG. 4B, and uses the exhaust fan 430 at a rotation frequency increased to the maximum rotation frequency (hereinafter referred to as "full speed") (Step S6 in FIG. 7B, state (b) in Table 1).

(iii') Next, the control section 200 determines whether or not 2 minutes, that is a preset second operating time as a period of time from the time when the emission of ultra fine particles is rapidly increased to the time when the emission is settled down, after the fixing temperature reached 180° C., has elapsed (Step S7 in FIG. 7B). As the process thereafter is similar to that in the flow chart of FIG. 7A, detailed explanation thereof will be omitted.

As described in (i') to (iii'), the control section 200 determines whether or not the fixing temperature of the heating roller 132 measured with the temperature sensor 311 has reached 180° C., i.e., determines whether or not the initial burst conditions are fulfilled. And the control section 200 operates the exhaust fan 430, i.e., the rotation frequency thereof is controlled. Consequently, only when specific temperature or time is satisfied, large part of the air flow A2 containing a large number of the ultra fine particles passes through the filter member 420. Therefore, it becomes possible to efficiently collect the ultra fine particles. Moreover, air near the heating roller 132 will not unduly be sucked to the outside of the apparatus by the exhaust fan 430, which prevents the heating roller 132 being cooled and the fixability of the fixing device 130 being deteriorated. Furthermore, the control section 200 controls the operation of the exhaust fan 430 so that the exhaust fan 430 is not constantly used at full speed. Therefore, according to this image forming apparatus, it becomes possible to prevent diffusion of fine particles to the environment inside and around the apparatus and desirably secure fixability of the fixing device 130, as well as to reduce energy consumption.

Second Embodiment

Figure 5A:
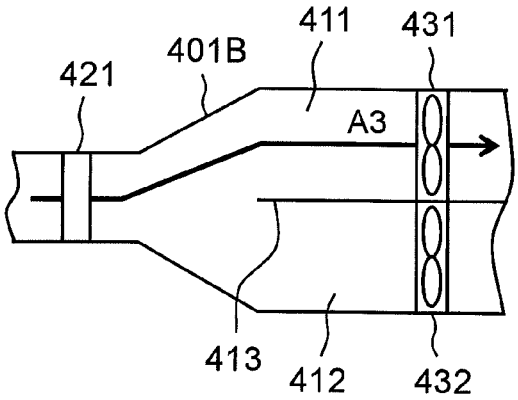
FIGS. 5A and 5B are detail views showing configuration and operation inside the duct of the image forming apparatus, respectively.

FIG. 5A shows a cross sectional configuration of inside the internal expanded section 401B, exhaust fans in one aspect (denoted by reference signs 431, 432) and the vicinity thereof in the image forming apparatus 100. It is to be noted that in the second embodiment, component members identical to those in the first embodiment are designated by identical reference signs to omit explanation.

As shown in FIG. 5A, the expanded section 401B has a first path 411 and a second path 412 parallel to the first path 411 formed by a divider plate 413. A filter member 421 is fixedly provided in the expanded section 401B upstream from the first path 411 and the second path 412 so as to close the expanded section 401B. The size of the cross section of the filter member 421 is equal to the size of the cross section of the expanded section 401B at a position where the filter member 421 is provided. The first exhaust fan 431 is provided in the first path 411. The second exhaust fan 432 is provided in the second path 412. Consequently, in the state shown in FIG. 5A, i.e., in the state when only the first exhaust fan 431 rotates, an air flow A3 all passes through the filter member 421 and travels through the first path 411. In the state shown in FIG. 5B, i.e., in the state where the first exhaust fan 431 and the second exhaust fan 432 rotate, an air flow A3 and an air flow A4 pass through the filter member 421 and travel through the first path 411 and the second path 412, respectively.

Figure 8A:
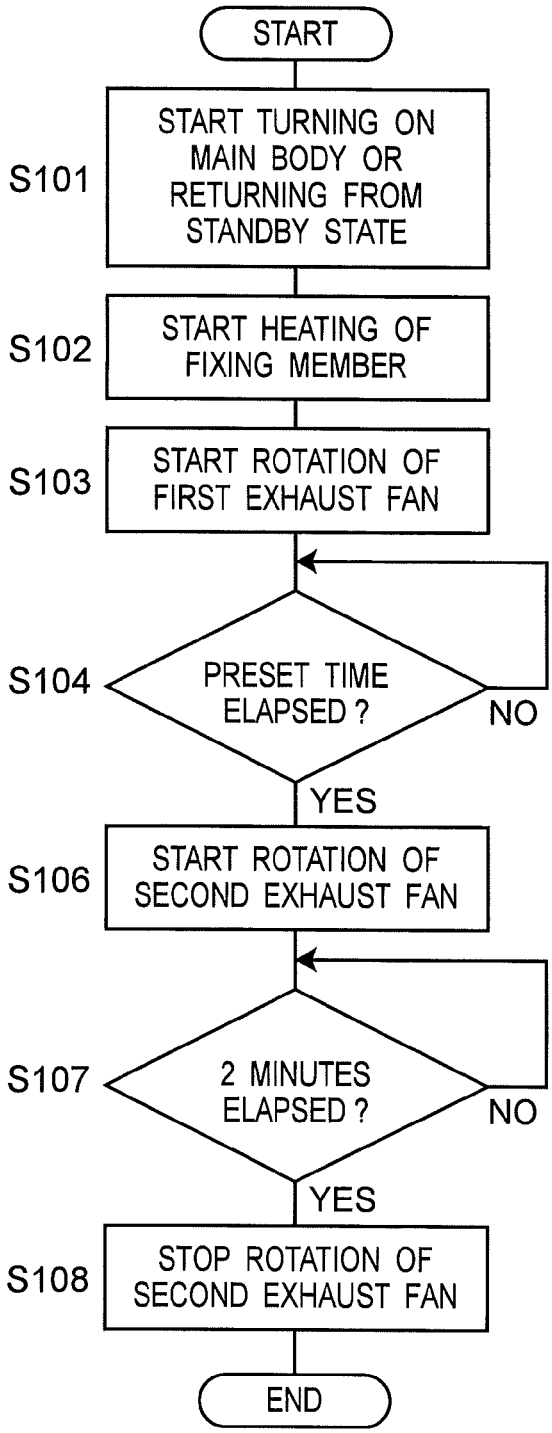
FIGS. 8A and 8B are flow charts for control of a rotation frequency of the exhaust fan by a control section of the image forming apparatus, respectively.

FIG. 8A shows a flow chart for control of the first exhaust fan 431 and the second exhaust fan 432 by a control section 200. Table 2 shows control of the first exhaust fan 431 and the second exhaust fan 432 by the control section 200 in every generation state of the ultra fine particles.

TABLE 2

| State | (a) | (b) | (c) |
|---|---|---|---|
| Ultra fine particles | Small amount | Large amount | Small amount |
| Time | In 30 sec. after turning on main body or in 20 sec. after start of returning from standby state | After elapse of 30 sec. after turning on main body or after elapse of 20 sec. after start of returning from standby state | After elapse of 2 min. after attaining to state (b) |
| Fixing temp. | Less than 180° C. | 180° C. | 180° C. |
| First exhaust fan | Full speed | Full speed | Full speed |
| Second exhaust fan | Stop | Full speed | Stop |

Figure 5B:
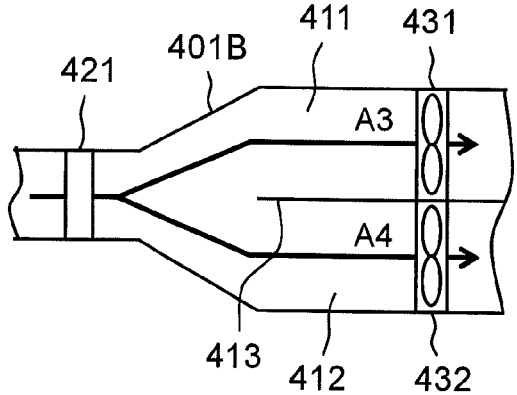

Description is now given of the operation of the first exhaust fan 431 and the second exhaust fan 432 with reference to FIG. 5A, FIG. 5B, FIG. 8A and Table 2.

In this example, after processing of Steps S101 and S102 in FIG. 8A (similar to the processing of Steps S1 and S2 in FIG. 7A), as shown in FIG. 5A, the control section 200 controls the first exhaust fan 431 to start rotation and uses the first exhaust fan 431 at full speed (Step S103 in FIG. 5A and FIG. 8A, state (a) in Table 2). Next, after processing of Steps S104 in FIG. 8A (similar to the processing of Step S4 in FIG. 7A), the control section 200 controls the second exhaust fan 432 to start rotation and uses the second exhaust fan 432 at full speed (Step S106 in FIG. 5B and FIG. 8A, state (b) in Table 2). Then, after processing of Step S107 in FIG. 8A (similar to the processing of Step S7 in FIG. 7A), the control section 200 controls the second exhaust fan 432 to stop rotation (Step S108 in FIG. 5A and FIG. 8A, state (c) in Table 2).

In the image forming apparatus 100 having the first exhaust fan 431 and the second exhaust fan 432, the ultra fine particles can efficiently be collected as in the first embodiment. Moreover, air near the heating roller 132 will not unduly be sucked to the outside of the apparatus by the first exhaust fan 431 and the second exhaust fan 432, which prevents the heating roller 132 being cooled and the fixability of the fixing device 130 being deteriorated. Furthermore, the control section 200 controls the first exhaust fan 431 and the second exhaust fan 432 so that the first exhaust fan 431 and the second exhaust fan 432 are not constantly used at full speed. Therefore, according to this image forming apparatus, it becomes possible to prevent diffusion of fine particles to the environment inside and around the apparatus and desirably secure fixability of the fixing device 130, as well as to reduce energy consumption.

If the initial burst conditions are fulfilled, the control section 200 operates the first exhaust fan 431 and the second exhaust fan 432 and uses the first exhaust fan 431 and second exhaust fan 432 at full speed. Therefore, since the air flows A3 and A4 containing a large number of the ultra fine particles pass through the filter member 421, the ultra fine particles can be collected more efficiently as compared with the case when only one exhaust fan is operated. If the initial burst conditions have not yet been fulfilled, the control section 200 operates only the first exhaust fan 431 and uses the first exhaust fan 431 at full speed. Therefore, as compared with the case when the first exhaust fan 431 and the second exhaust fan 432 are operated, it becomes possible to reliably reduce energy consumption.

Figure 8B:
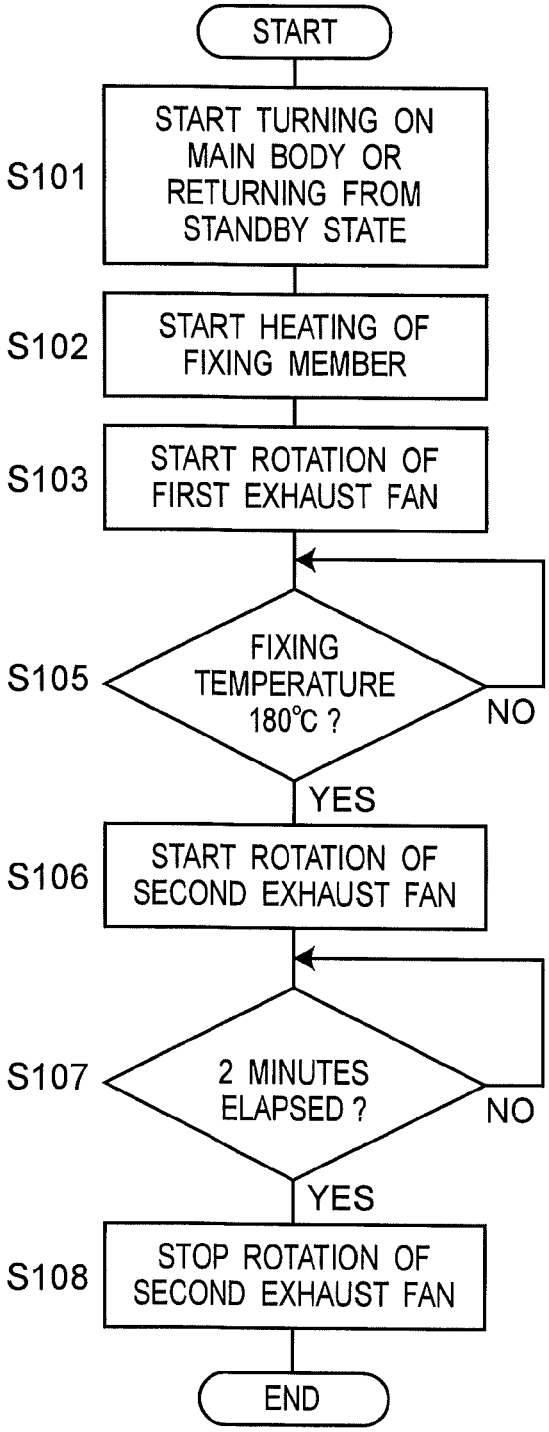

It is to be noted that the control section 200 may control the first exhaust fan 431 and second exhaust fan 432 based on the control shown in the flow chart for control in FIG. 8B. It is to be noted that in the flow chart of FIG. 8B, the steps identical to those in the flow chart of FIG. 8A are designated by identical step number to omit detailed explanation. As shown in FIG. 8B, the processing of Step S104 in FIG. 8A is replaced with the processing of Step S105 in FIG. 8B, i.e., initial burst conditions are determined based on fixing temperature (similar to the processing of Step S5 in FIG. 7B).

Third Embodiment

Figure 6A:
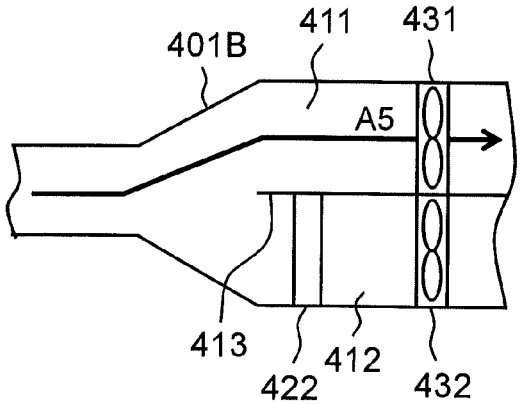
FIGS. 6A and 6B are detail views showing configuration and operation inside the duct of the image forming apparatus, respectively.

FIG. 6A shows a cross sectional configuration inside the internal expanded section 401B, exhaust fans in one aspect (denoted by reference signs 431, 432) and the vicinity thereof in the image forming apparatus 100. It is to be noted that in the third embodiment, component members identical to those in the second embodiment are designated by identical reference signs to omit explanation.

As shown in FIG. 6A, the filter member 422 is fixedly provided in a second path 412 upstream from the second exhaust fan 432 so as to infill the second path 412. The size of the cross section of the filter member 422 is equal to the size of the cross section of the second path 412 at a position where the filter member 422 is provided. Consequently, in the state shown in FIG. 6A, i.e., in the state when only the first exhaust fan 431 rotates, an air flow A5 all travels through a first path 411. In the state shown in FIG. 6A, i.e., in the state where only the second exhaust fan 432 rotates, an air flow A6 all passes through the filter member 422 and travels through the second path 412.

Figure 9A:
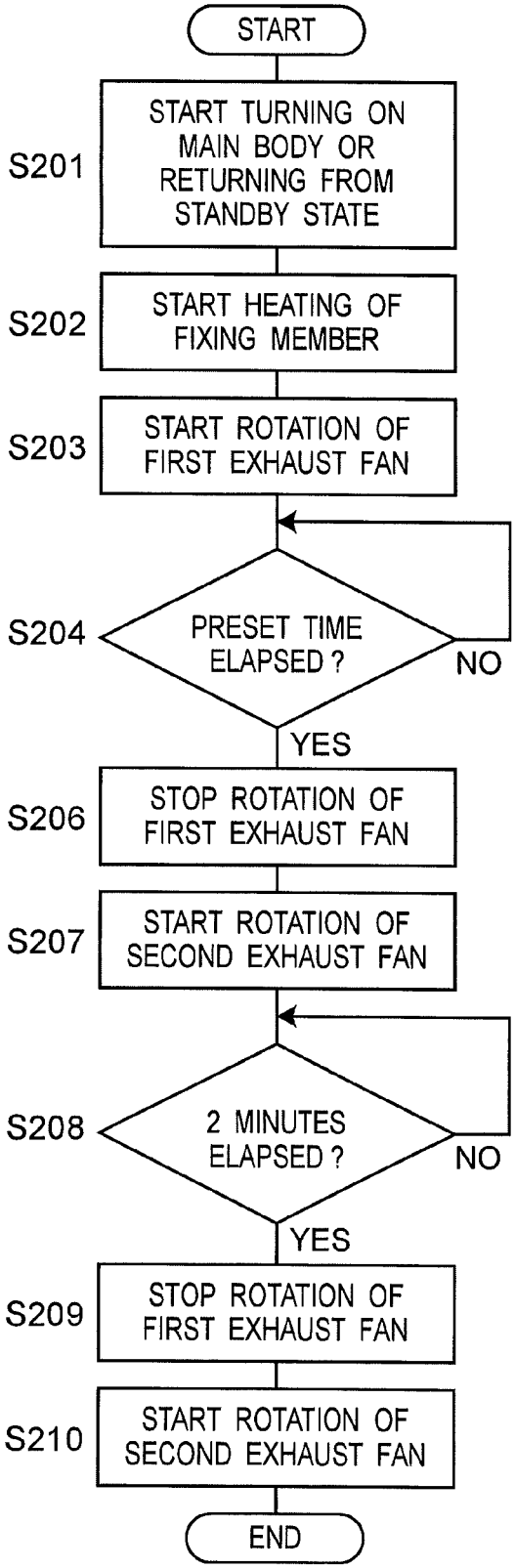
FIGS. 9A and 9B are flow charts for control of a rotation frequency of the exhaust fan by a control section of the image forming apparatus, respectively.

FIG. 9A shows a flow chart for control of the first exhaust fan 431 and the second exhaust fan 432 by a control section 200. Table 3 shows control of the first exhaust fan 431 and the second exhaust fan 432 by the control section 200 in every generation state of the ultra fine particles.

TABLE 3

| State | (a) | (b) | (c) |
|---|---|---|---|
| Ultra fine particles | Small amount | Large amount | Small amount |
| Time | In 30 sec. after turning on main body or in 20 sec. after start of returning from standby state | After elapse of 30 sec. after turning on main body or after elapse of 20 sec. after start of returning from standby state | After elapse of 2 min. after attaining to state (b) |
| Fixing temp. | Less than 180° C. | 180° C. | 180° C. |
| First exhaust fan | Full speed | Stop | Full speed |
| Second exhaust fan | Stop | Full speed | Stop |

Figure 6B:
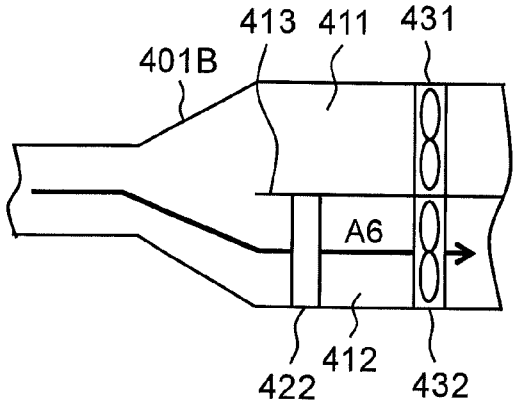

Description is now given of the operation of the first exhaust fan 431 and the second exhaust fan 432 with reference to FIG. 6A, FIG. 6B, FIG. 9A and Table 3.

In this example, after processing of Steps S201 and S202 in FIG. 9A (similar to the processing of Steps S1 and S2 in FIG. 7A), as shown in FIG. 6A, the control section 200 controls the first exhaust fan 431 to start rotation and uses the first exhaust fan 431 at full speed (Step S203 in FIG. 9A, state (a) in Table 3). Next, after processing of Step S204 in FIG. 9A (similar to the processing of Step S4 in FIG. 7A), the control section 200 controls the first exhaust fan 431 to stop rotation (Step S206 in FIG. 9A). Further as shown in FIG. 6B, the control section 200 controls the second exhaust fan 432 to start rotation and uses the second exhaust fan 432 at full speed (Step S207 in FIG. 9A, state (b) in Table 3). Then, after processing of Step S208 in FIG. 9A (similar to the processing of Step S7 in FIG. 7A), the control section 200 controls the first exhaust fan 431 to start rotation and uses the first exhaust fan 431 at full speed (Step S209 in FIG. 9A). Then, as shown in FIG. 6A, the control section 200 controls the second exhaust fan 432 to stop rotation of the second exhaust fan 432 (Step S206 in FIG. 9A, state (c) in Table 3).

In the image forming apparatus 100 having the first exhaust fan 431 and the second exhaust fan 432, the ultra fine particles can efficiently be collected as in the first embodiment. Moreover, air near the heating roller 132 will not unduly be sucked to the outside of the apparatus by the first exhaust fan 431 and the second exhaust fan 432, which prevents the heating roller 132 being cooled and the fixability of the fixing device 130 being deteriorated. Furthermore, the control section 200 controls the first exhaust fan 431 and the second exhaust fan 432 so that the first exhaust fan 431 and the second exhaust fan 432 are not constantly used at full speed. Therefore, according to this image forming apparatus, it becomes possible to prevent diffusion of fine particles to the environment inside and around the apparatus and desirably secure fixability of the fixing device 130, as well as to reduce energy consumption.

If the initial burst conditions have been fulfilled, the control section 200 operates only the second exhaust fan 432 and uses the second exhaust fan 432 at full speed. Therefore, it is possible to control the second exhaust fan 432 so that the air flow A6 containing a large number of the ultra fine particles all passes through the filter member 422. As a consequence, the ultra fine particles can be collected more efficiently. On the other hand, if the initial burst conditions are not fulfilled, the control section 200 operates only the first exhaust fan 431 and uses the first exhaust fan 431 at full speed. Therefore, as compared with the case when the first exhaust fan 431 and the second exhaust fan 432 are operated, it becomes possible to reliably reduce energy consumption. Further, the air flow A5 does not pass through the filter member 422 in this case. Therefore, since the filter member 422 can be protected, the life span of the filter member 422 can be lengthened.

Figure 9B:
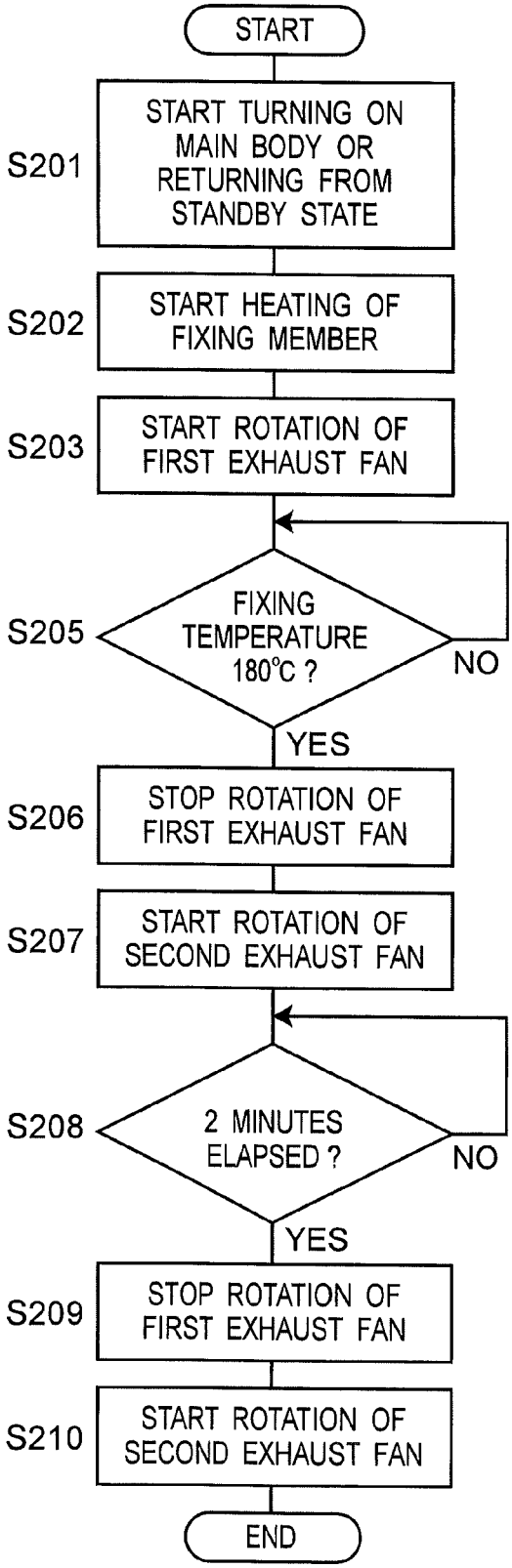
Figure 10B:
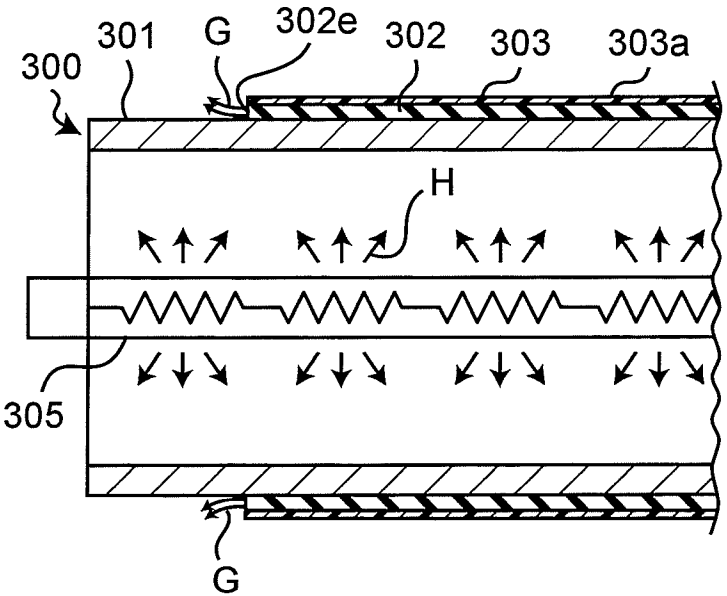
Fig.10B RELATED ART
FIG. 10B is a view showing the state of siloxane as ultra fine particles being emitted from an end portion of a rubber layer in the heating roller.
Figure 10A:
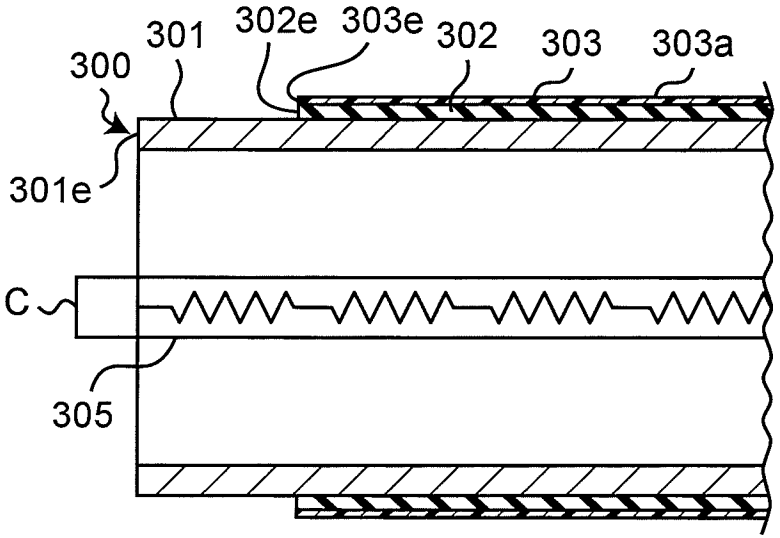
Fig.10A RELATED ART
FIG. 10A is a cross sectional view showing a general configuration of a heating roller.

It is to be noted that the control section 200 may control the first exhaust fan 431 and second exhaust fan 432 based on the control shown in the flow chart for control in FIG. 9B.

In each of the above-mentioned embodiments, the exhaust fan is used at full speed or half speed. It should naturally be understood that without being limited thereto, the exhaust fan may be used at rotation frequencies other than full speed or half speed.

In each of the above-stated embodiments, the temperature sensor 311 is provided so as to be in contact with the heating roller 132. It should naturally be understood that without being limited thereto, the temperature sensor 311 may be provided so as not to be in contact with the heating roller 132 in the invention.

In each of the above-stated embodiments, the exhaust fan 430 was structured to be placed inside the expanded section 401B. It should naturally be understood that the invention is not limited thereto but is preferably applicable to the case where the exhaust fan 430 is placed outside the duct 400 as long as the exhaust fan 430 is placed in the vicinity of the end portions of the duct 400.

In each of the above-stated embodiments, the fixing member was configured as a cylindrical fixing roller. It should naturally be understood that the present invention is not limited thereto but is preferably applicable to the case where the fixing member is an annular fixing belt.

In each of the above-mentioned embodiments, the pressure roller can also be considered as a fixing member. A heater may be built not only in the fixing roller but also in the pressure roller.

Although the filter member was provided upstream from the exhaust fan in each of the above-stated embodiments, the filter member may be placed downstream from the exhaust fan.

Although the invention was applied to a tandem type color image forming apparatus in each of the above-stated embodiments, the invention is not limited to this configuration. The photoconductor, the charging means, the exposure means, the developing means, the transfer means, and the fixing means are not limited to have the configuration and layout disclosed in the embodiments but may have other configurations and layouts. The invention is widely applicable to the image forming apparatuses of other types such as rotary configuration type and direct transfer type.

The invention is also applicable to printers, copying machines, facsimiles, multi-functional machines having the functions of these and hard copy systems for data processing/editing and printing.

As described above, an image forming apparatus in one aspect of the present invention comprises:

a fixing member having a cylindrical or annular shape for fixing an image onto a sheet which is in pressure contact with an outer surface thereof;

a heating source for heating the fixing member to a fixing temperature;

a duct which is provided in a position facing the fixing member with respect to a width direction perpendicular to a circumferential direction of the fixing member and which has an inlet for taking in fine particles generated from the fixing member;

a filter member which is provided inside the duct and which can trap the fine particles which flow through the duct;

an exhaust fan provided in the duct upstream or downstream from the filter member for generating an air flow going from the inlet to an outlet of the duct; and a control section for controlling the operation of the exhaust fan according to initial burst conditions under which the fine particles are emitted from the fixing member.

In the image forming apparatus of this invention, the fixing member is heated by the heating source to a specified target temperature (a fixing temperature). A conveyed sheet is brought into pressure contact with the outer surface of the fixing member to fix an image onto the sheet. Once the fixing member is heated to around the fixing temperature, ultra fine particles such as siloxane (fine particles with a particle size of 100 nm or less) are rapidly generated from, for example, the rubber layer of the fixing member. Since the outer surface of the rubber layer is generally covered with the outer layer, the ultra fine particles are likely to be emitted from the end portion of the rubber layer. In this image forming apparatus, the ultra fine particles which are likely to be emitted from the end portion of the rubber layer are taken into the duct through an inlet provided in a position facing the fixing member with respect to a width direction perpendicular to the circumferential direction of the fixing member. The ultra fine particles taken into the duct flow through the duct from the inlet toward the outlet of the duct getting on the air flow generated with the exhaust fan provided in the duct or in the outlet. The ultra fine particles which flow through the duct are trapped by the filter member provided inside the duct. As a result, the image forming apparatus can prevent diffusion of fine particles to the environment inside and around the apparatus.

Moreover, the emission of the ultra fine particles occurs only when a specific temperature or time is satisfied, that is, only when initial burst conditions are fulfilled. In this image forming apparatus, the control section controls the exhaust fan according to the initial burst conditions. In short, only when a specific temperature or time is satisfied, large part of the air flow containing a large number of the ultra fine particles passes through the filter member. As a consequence, it becomes possible to efficiently collect the ultra fine particles. Moreover, air near the fixing member will not unduly be sucked to the outside of the apparatus by the first exhaust fan, which prevents the fixing member being cooled and the fixability of the fixing device being deteriorated. Further, the exhaust fan is not controlled so as to constantly rotate at full speed. Therefore, according to this image forming apparatus, it becomes possible to desirably secure the fixability of the fixing device as well as to reduce energy consumption.

In the image forming apparatus of one embodiment, the control section controls the operation of the exhaust fan according to the initial burst conditions, depending on whether or not a preset standby time has elapsed after start of heating of the fixing member upon turning on a main body of the image forming apparatus or upon returning from standby state of the main body of the image forming apparatus.

In the image forming apparatus of this one embodiment, the exhaust fan is controlled for example, so that the exhaust fan can be used at the rotation frequency of a half of the maximum rotation frequency until the elapse of the preset standby time after the start of heating of the fixing member. Accordingly, as compared with the case when the exhaust fan is constantly used at the maximum rotation frequency, it becomes possible to reliably reduce energy consumption. Since the control section controls the operation of the exhaust fan based on the time, the exhaust fan can be controlled with simple configuration as compared with the case of using sensors and the like.

In the image forming apparatus of one embodiment, the control section increases rotation frequency of the exhaust fan only for a preset first operating time after the standby time has elapsed as compared with before the standby time has elapsed.

In the image forming apparatus of this one embodiment, the control section controls the operation of the exhaust fan so as to increase the rotation frequency thereof from the rotation frequency prior to the elapse of the standby time, that is one of the initial burst conditions, only for a preset first operating time after the elapse of the standby time. Therefore, as compared with the case when the exhaust fan is constantly used at the maximum rotation frequency, the ultra fine particles can be collected with more efficiency.

The image forming apparatus of one embodiment comprises:

a temperature sensor for measuring temperature of the fixing member, wherein the control section controls the operation of the exhaust fan according to the initial burst conditions, depending on whether or not the temperature of the fixing member measured with the temperature sensor has reached a preset threshold temperature.

In the image forming apparatus of this one embodiment, the exhaust fan is controlled for example, so that the exhaust fan can be used at the rotation frequency of a half of the maximum rotation frequency until the temperature of the fixing member measured with the temperature sensor has reached the preset threshold temperature. Accordingly, as compared with the case when the exhaust fan is constantly used at the maximum rotation frequency, it becomes possible to reliably reduce energy consumption. Since the control section controls the operation of the exhaust fan based on the temperature, the exhaust fan can be controlled more precisely on the temperature, that is one of the initial burst conditions, as compared with the case when the control section controls the operation of the exhaust fan based on the time.

In the image forming apparatus of one embodiment, the control section increases the rotation frequency of the exhaust fan only for a preset second operating time after the temperature of the fixing member measured with the temperature sensor has reached the threshold temperature as compared with before the temperature of the fixing member measured with the temperature sensor has reached the threshold temperature.

In the image forming apparatus of this one embodiment, the control section controls the operation of the exhaust fan and increases the rotation frequency of the exhaust fan from the rotation frequency before the temperature of the fixing member has reached the threshold temperature only for the preset second operating time after the temperature of the fixing member measured with the temperature sensor, that is one of the initial burst conditions, has reached the threshold temperature. Therefore, as compared with the case when the exhaust fan is constantly used at the maximum rotation frequency, the ultra fine particles can be collected with more efficiency.

In the image forming apparatus of one embodiment, the duct has at least a first path and a second path parallel to the first path in the duct upstream or downstream from the filter member, wherein the first and second paths respectively have first and second exhaust fans placed as the exhaust fan, and wherein the control section controls the operation of one of or both the first and second exhaust fans according to the initial burst conditions.

In the image forming apparatus of this one embodiment, the control section controls the operation of the first and second exhaust fans according to the initial burst conditions. Therefore, if the initial burst conditions have been fulfilled for example, controlling the operation of both the first and second exhaust fans makes it possible to control the air flow so that the air flow containing a large number of the ultra fine particles passes through the filter member more than the case of controlling the operation of one exhaust fan. As a consequence, the ultra fine particles can be collected more efficiently. On the other hand, if the initial burst conditions are not fulfilled, controlling the operation of only one of the first and second exhaust fans makes it possible to reliably reduce energy consumption as compared with the case of controlling the operation of both the first and second exhaust fans.

In the image forming apparatus of one embodiment, the duct has at least a first path and a second path parallel to the first path in the duct, wherein the first and second paths respectively have first and second exhaust fans placed as the exhaust fan, wherein the filter member is placed only in the second path in the duct, and wherein the control section controls the operation of one of the first and second exhaust fans according to the initial burst conditions.

In the image forming apparatus of this one embodiment, the filter member is not provided in the first path. Moreover, the control section controls the operation of one of the first and second exhaust fans according to the initial burst conditions. Therefore, if the initial burst conditions have been fulfilled for example, operating only the second exhaust fan makes it possible to control the air flow so that the air flow containing a large number of the ultra fine particles all passes through the filter member. As a consequence, the ultra fine particles can be collected more efficiently. If the initial burst conditions are not fulfilled, operating only the first exhaust fan makes it possible to reliably reduce energy consumption as compared with the case of operating both the first and second exhaust fans. Further, the air flow does not constantly pass through the filter member in this case. Therefore, since the filter member can be protected, the life span of the filter member can be lengthened.

In the image forming apparatus of one embodiment, the filter member is an electrostatic filter.

In the image forming apparatus of this one embodiment, the first filter member is an electrostatic filter. Therefore, the ultra fine particles can more efficiently be trapped due to Coulomb force.

According to the image forming apparatus of the invention, it becomes possible to prevent diffusion of fine particles to the environment inside and around the apparatus and desirably secure fixability of a fixing device, as well as to reduce energy consumption by trapping ultra fine particles generated from a fixing member while controlling the operation of an exhaust fan.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An image forming apparatus, comprising:

a fixing member having a cylindrical or annular shape for fixing an image onto a sheet which is in pressure contact with an outer surface thereof;

a heating source for heating the fixing member to a fixing temperature;

a duct which is provided in a position facing the fixing member with respect to a width direction perpendicular to a circumferential direction of the fixing member and which has an inlet for taking in fine particles generated from the fixing member;

a filter member which is provided inside the duct and which can trap the fine particles which flow through the duct;

an exhaust fan provided in the duct upstream or downstream from the filter member for generating an air flow going from the inlet to an outlet of the duct; and a control section for controlling the operation of the exhaust fan so that the quantity of air passing through the filter member for a preset operating time, which occurs after an initial preset time has elapsed from a start of heating of the fixing member, or which occurs after the temperature of the fixing member has reached a preset threshold temperature after a start of heating of the fixing member, is different compared to the quantity of air passing through filter member before and after the preset operating time, as control according to initial burst conditions under which the fine particles are emitted from the fixing member.

2. The image forming apparatus as claimed in claim 1, wherein the control section controls the operation of the exhaust fan according to the initial burst conditions, depending on whether or not a preset standby time has elapsed after start of heating of the fixing member upon turning on a main body of the image forming apparatus or upon returning from standby state of the main body of the image forming apparatus.

3. The image forming apparatus as claimed in claim 2, wherein the control section increases rotation frequency of the exhaust fan only for a preset first operating time after the standby time has elapsed as compared with before the standby time has elapsed.

4. The image forming apparatus as claimed in claim 1, comprising:

a temperature sensor for measuring temperature of the fixing member, wherein the control section controls the operation of the exhaust fan according to the initial burst conditions, depending on whether or not the temperature of the fixing member measured with the temperature sensor has reached a preset threshold temperature.

5. The image forming apparatus as claimed in claim 4, wherein the control section increases the rotation frequency of the exhaust fan only for a preset second operating time after the temperature of the fixing member measured with the temperature sensor has reached the threshold temperature as compared with before the temperature of the fixing member measured with the temperature sensor has reached the threshold temperature.

6. The image forming apparatus as claimed in claim 1, wherein the duct has at least a first path and a second path parallel to the first path in the duct upstream or downstream from the filter member, wherein the first and second paths respectively have first and second exhaust fans placed as the exhaust fan, and wherein the control section controls the operation of one of or both the first and second exhaust fans according to the initial burst conditions.

7. The image forming apparatus as claimed in claim 6, wherein the control section controls the operation of the exhaust fan according to the initial burst conditions, depending on whether or not a preset standby time has elapsed after start of heating of the fixing member upon turning on a main body of the image forming apparatus or upon returning from standby state of the main body of the image forming apparatus.

8. The image forming apparatus as claimed in claim 7, wherein the control section operates one of the first and second exhaust fans until the standby time has elapsed, and operates both the first and second exhaust fans only for a preset operating time after the standby time has elapsed.

9. The image forming apparatus as claimed in claim 6, comprising:

a temperature sensor for measuring temperature of the fixing member, wherein the control section controls the operation of the exhaust fan according to the initial burst conditions, depending on whether or not the temperature of the fixing member measured with the temperature sensor has reached a preset threshold temperature.

10. The image forming apparatus as claimed in claim 9, wherein the control section operates one of the first and second exhaust fans until the temperature of the fixing member measured with the temperature sensor has reached the threshold temperature, and operates both the first and second exhaust fans only for a preset operating time after the temperature of the fixing member has reached the threshold temperature.

11. The image forming apparatus as claimed in claim 1, wherein the duct has at least a first path and a second path parallel to the first path in the duct, wherein the first and second paths respectively have first and second exhaust fans placed as the exhaust fan, wherein the filter member is placed only in the second path in the duct, and wherein the control section controls the operation of one of the first and second exhaust fans according to the initial burst conditions.

12. The image forming apparatus as claimed in claim 11, wherein the control section controls the operation of the exhaust fan according to the initial burst conditions, depending on whether or not a preset standby time has elapsed after start of heating of the fixing member upon turning on a main body of the image forming apparatus or upon returning from standby state of the main body of the image forming apparatus.

13. The image forming apparatus as claimed in claim 12, wherein the control section operates one of the first and second exhaust fans until the standby time has elapsed, and operates both the first and second exhaust fans only for a preset operating time after the standby time elapsed.

14. The image forming apparatus as claimed in claim 11, comprising:

a temperature sensor for measuring temperature of the fixing member, wherein the control section controls the operation of the exhaust fan according to the initial burst conditions, depending on whether or not the temperature of the fixing member measured with the temperature sensor has reached a preset threshold temperature.

15. The image forming apparatus as claimed in claim 14, wherein the control section operates one of the first and second exhaust fans until the temperature of the fixing member measured with the temperature sensor has reached the threshold temperature, and operates both the first and second exhaust fans only for a preset operating time after the temperature of the fixing member has reached the threshold temperature.

16. The image forming apparatus as claimed in claim 1, wherein the filter member is an electrostatic filter.

17. The image forming apparatus as claimed in claim 1, wherein the control section controls the operation of the exhaust fan to be at maximum rotation frequency during initial burst conditions under which the fine particles are emitted from the fixing member and decreases the rotation frequency of the exhaust fan after determining that the exhaust fan has been at the maximum rotation frequency for about two minutes.

* * * * *